US011261048B2

(12) United States Patent
Allen, Jr. et al.

(10) Patent No.: US 11,261,048 B2
(45) Date of Patent: Mar. 1, 2022

(54) LAYBOY HAVING AT LEAST ONE DIVERTED BELT SECTION

(71) Applicant: A. G. Stacker Inc., Weyers Cave, VA (US)

(72) Inventors: Clarence C. Allen, Jr., Mt. Crawford, VA (US); Joseph Wunder, Lexington, VA (US); Ryan Gerber, Dayton, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 226 days.

(21) Appl. No.: 16/787,102

(22) Filed: Feb. 11, 2020

(65) Prior Publication Data

US 2020/0255251 A1 Aug. 13, 2020

Related U.S. Application Data

(60) Provisional application No. 62/804,984, filed on Feb. 13, 2019.

(51) Int. Cl.

| | |
|---|---|
| ***B65H 29/12*** | (2006.01) |
| ***B65H 5/02*** | (2006.01) |
| ***B65H 31/32*** | (2006.01) |

(52) U.S. Cl.

CPC ..... *B65H 31/32* (2013.01); *B65H 5/023* (2013.01); *B65H 29/12* (2013.01); *B65H 2404/261* (2013.01)

(58) Field of Classification Search

CPC ..... B65H 29/12; B65H 5/023; B65H 31/32; B65H 2404/261

See application file for complete search history.

(56) References Cited

U.S. PATENT DOCUMENTS

| | | | | |
|---|---|---|---|---|
| 3,860,232 | A * | 1/1975 | Martin | B65H 29/12 271/198 |
| 5,123,639 | A * | 6/1992 | Edwards | B65H 29/145 271/212 |
| 6,427,097 | B1 * | 7/2002 | Martin | B65G 21/10 700/230 |
| 7,854,428 | B2 * | 12/2010 | Allen, Jr. | B65H 29/12 271/272 |
| 9,027,737 | B2 | 5/2015 | Talken et al. | |
| 9,771,227 | B2 | 9/2017 | Allen, Jr. et al. | |
| 2012/0053035 | A1 * | 3/2012 | Diehr | B65H 5/023 493/128 |

* cited by examiner

*Primary Examiner* — Luis A Gonzalez

(74) *Attorney, Agent, or Firm* — J-Tek Law PLLC; Jeffrey D. Tekanic; Scott T. Wakeman

(57) ABSTRACT

A layboy includes an upper belt section with a plurality of transversely spaced upper belts that extend in a longitudinal direction such that bottom portions of the upper belts lie in a first plane that defines an upper boundary of a transport path through the layboy and a lower belt section having a plurality of transversely spaced lower belts that extend in the longitudinal direction such that top portions of the lower belts lie in a second plane that defines an upper boundary of the transport path. The bottom portion of one of the top belts and/or the top portion of one of the bottom belts extends away from the transport path to define a gap in the transport path at which scrap moving through the layboy can fall out of the transport path.

12 Claims, 7 Drawing Sheets

LAYBOY HAVING AT LEAST ONE DIVERTED BELT SECTION

CROSS-REFERENCE TO RELATED APPLICATIONS

The present application claims the benefit of U.S. Provisional Patent Application No. 62/804,984, filed Feb. 13, 2019, the entire contents of which is hereby incorporated by reference.

BACKGROUND

A layboy is a conveyor that may be mounted at the discharge side of a rotary die cut machine for receiving one or more streams of sheets or blanks produced by the rotary die cut machine. The layboy has an upper belt section comprising a plurality of rotatable belts extending in a sheet transport direction and a lower belt section comprising a plurality of rotatable belts extending in the sheet transport direction. A sheet transport path is defined between the bottoms of the upper belts and the tops of the lower belts. Blanks output by the rotary die cut machine enter an upstream end of the layboy at a series of entry nips defined by pairs of the upper and lower belts, are transported along the sheet transport path by the moving upper and lower belts and are discharged from a discharge end of the layboy.

A conventional rotary die cut machine cuts finished blanks from sheets of material that are input to the machine. Scrap is produced during this process which consists mainly of the portion of the input material that does not become part of a finished blank. In addition, each blank may include slots or through-openings. The material cut from the input material to form these slots and through-openings also constitutes scrap.

Most scrap drops beneath or immediately downstream of the die cut machine as it operates. However scrap, especially small, lightweight pieces of scrap, may be ejected from the die cut machine in such a manner that it falls into the layboy section from above or is drawn into the intake end of the layboy section either alone or along with the blanks. Excessive scrap in the transport path from the die cut machine to the final stack of blanks may adversely affect the transport of the blanks. That is, the scrap may interfere with the alignment of the blanks or lead to jams. Alternately, if the scrap is carried all the way through the transport path and into the final stack of blanks, the blanks in the stack will have gaps therebetween where the scrap material is present thus resulting in a crooked, or oversized or non-uniform stack of blanks. It would therefore be desirable to eliminate or at least reduce the amount scrap material in the transport path of a layboy.

SUMMARY

This problem and others are addressed by embodiments of the present disclosure, a first aspect of which comprises a layboy having an upstream end, a downstream end spaced from the upstream end in a longitudinal direction, an upper belt section and a lower belt section. The upper belt section includes a plurality of transversely spaced upper belts extending in the longitudinal direction from the upstream end to the downstream end, each of the upper belts having a bottom defining an upper boundary of a transport path through the layboy. The lower belt section includes a plurality of transversely spaced lower belts extending in the longitudinal direction from the upstream end to the downstream end, each of the lower belts having a top defining a lower boundary of the transport path. The bottom of at least one of the upper belts includes a first portion extending from the upstream end to a first diversion guide, a second portion extending from the downstream end to a second diversion guide, a diverted portion between the first diversion guide and the second diversion guide at which the bottom of the at least one of the upper belts extends from the first diversion guide to a third diversion guide offset from the transport path and from the third diversion guide to the second diversion guide such that the diverted portion of the belt is spaced from the transport path. In addition or in the alternative, the top of at least one of the lower belts includes a first portion extending from the upstream end to a first diversion guide, a second portion extending from the downstream end to a second diversion guide, a diverted portion between the first diversion guide and the second diversion guide at which the top of the at least one of the lower belts extends from the first diversion guide to a third diversion guide offset from the transport path and from the third diversion guide to the second diversion guide such that the diverted portion of the belt is spaced from the transport path.

A layboy according to another aspect of the disclosure has an upstream end, a downstream end spaced from the upstream end in a longitudinal direction, an upper belt section and a lower belt section. The upper belt section includes a plurality of transversely spaced upper belts extending in the longitudinal direction, bottom portions of the plurality of upper belts lying in a first plane defining an upper boundary of a transport path from the upstream end to the downstream end. The lower belt section includes a plurality of transversely spaced lower belts extending in the longitudinal direction, top portions of the lower belts lying in a second plane defining an upper boundary of the transport path. The bottom portion of at least one of the upper belts extends away from the first plane and away from the second plane to define one side of a gap in the upper boundary of the transport path, and/or the top portion of at least one of the lower belts extends away from the first plane and away from the second plane to define one side of a gap in the lower boundary of the transport path.

A further aspect of the disclosure comprises a layboy having an upstream end, a downstream end spaced from the upstream end in a longitudinal direction, an upper belt section and a lower belt section. The upper belt section includes a plurality of upper arms, each of the upper arms having an upstream belt support at the upstream end and a downstream belt support at the downstream end and an upper belt supported by and extending around the upstream belt support and downstream belt support, the upper belt having a bottom portion defining an upper boundary of a transport path through the layboy. The lower belt section includes a plurality of lower arms, each of the lower arms including an upstream belt support at the upstream end of the lower arm and a downstream belt support at the downstream end of the lower arm and a lower belt supported by and extending around the upstream belt support on the lower arm and the downstream belt support on the lower arm, the lower belt having a top portion defining a lower boundary of the transport path. A support member depends from one of the upper arms and includes a first diversion guide, a second diversion guide and a third diversion guide, wherein the upper belt extends from the upstream belt support to the first diversion guide, the third diversion guide, the second diversion guide and the downstream belt support, in order, and wherein the third diversion guide is offset from the transport path such that a gap in the transport path is formed between the first diversion guide and the second diversion guide.

BRIEF DESCRIPTION OF THE DRAWINGS

These features will be better understood after a reading of the following detailed description in connection with the attached drawings, wherein.

DETAILED DESCRIPTION

Figure 1:
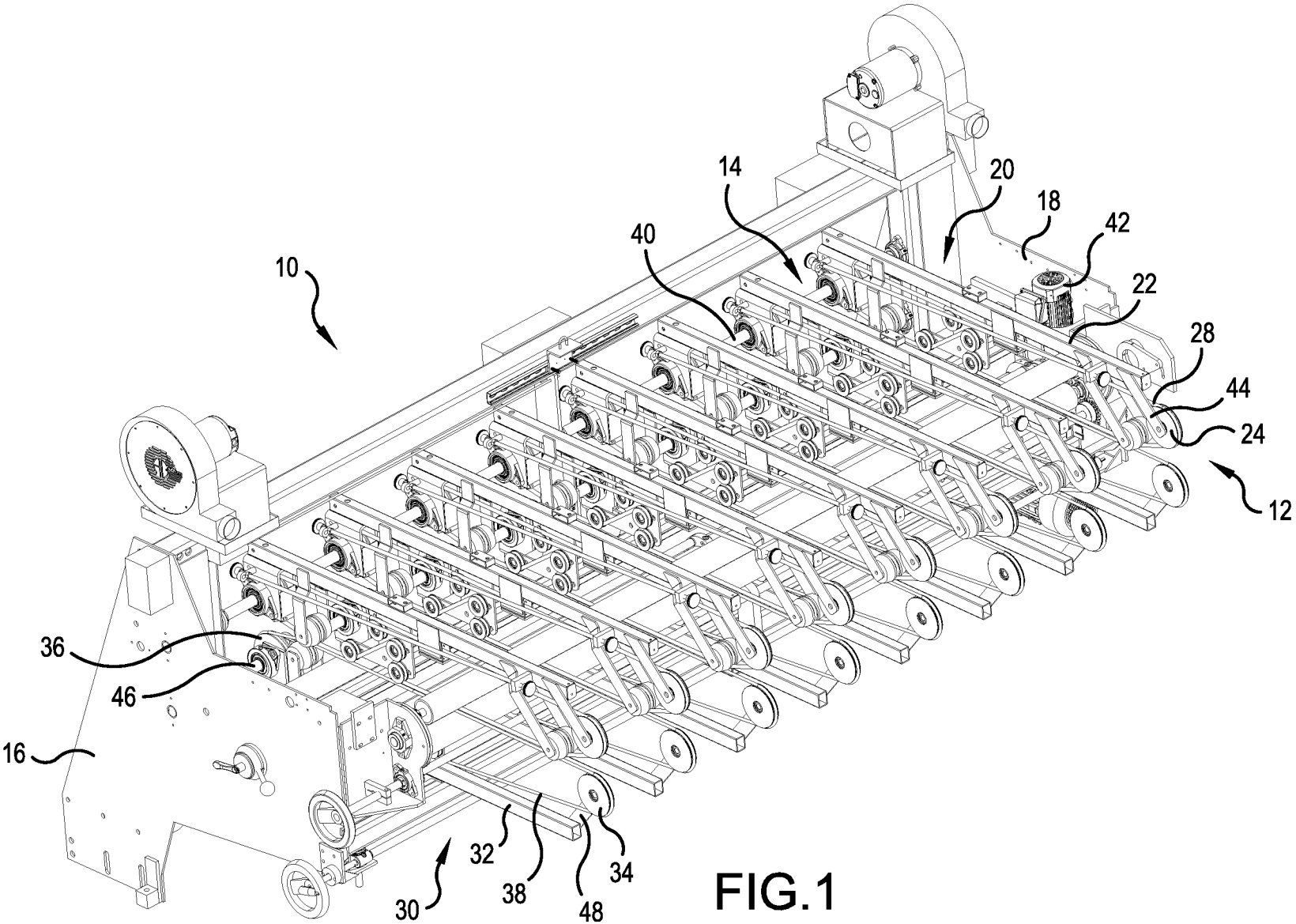
FIG. 1 is a perspective view of a layboy according to a first embodiment of the present disclosure which layboy includes a plurality of lower arms supporting lower belts and a plurality of upper arms supporting upper belts which upper belts include diverted portions.

Referring now to the drawings, wherein the showings are for the purpose of illustrating preferred embodiments of the disclosure only and not for the purpose of limiting same, FIG. 1 shows a layboy 10 having an input end 12, a discharge end 14, a left side 16 and a right side 18. Blanks of material (not illustrated) are received at the input end 12, from the output of a rotary die cut machine (not illustrated), for example, and travel in a direction toward the discharge end 14 which direction may be referred to herein as a "sheet transport direction" or a "longitudinal direction." The direction perpendicular to the longitudinal direction from the left side 16 to the right side 18 may be referred to as a "transverse direction." The direction perpendicular to both the longitudinal direction and the transverse direction may be referred to as the vertical or up-down direction.

Figure 2:
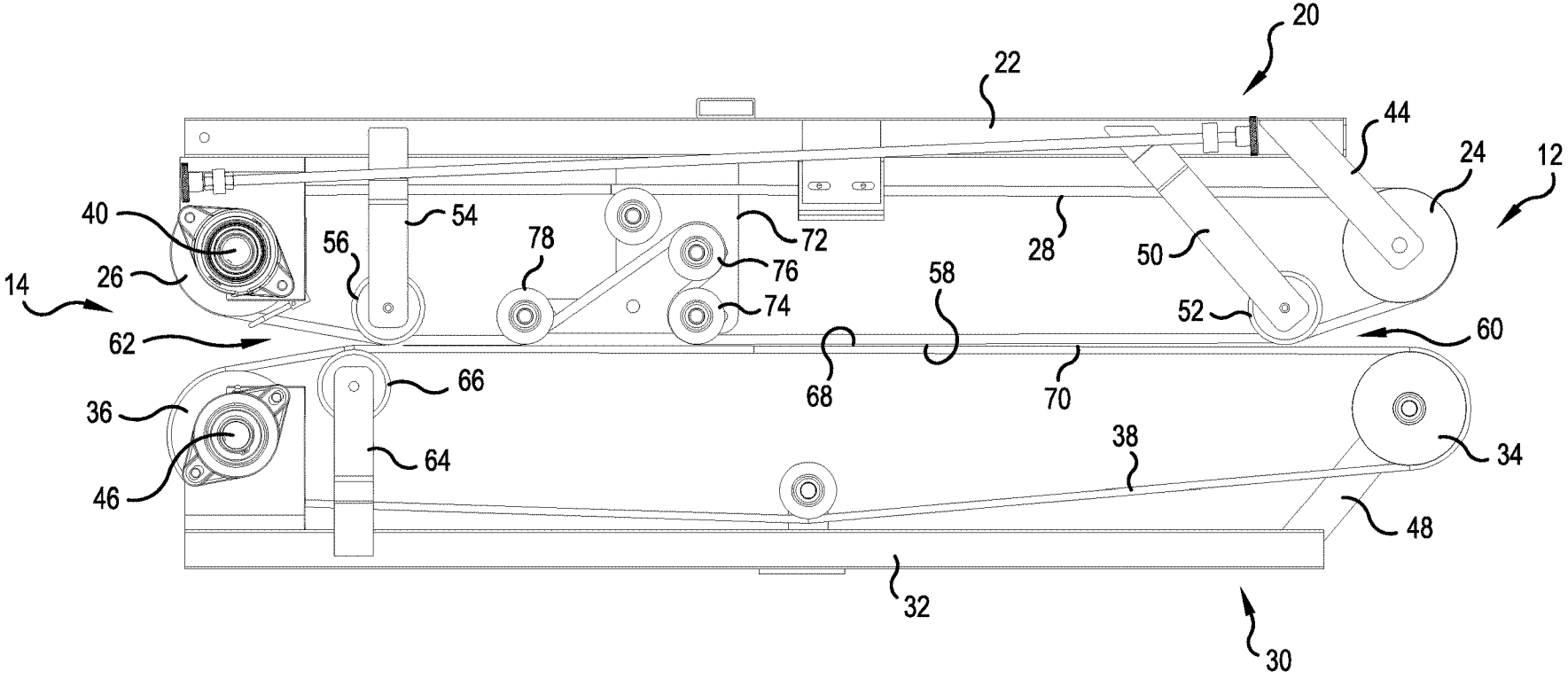
FIG. 2 is a left side elevational view of an upper arm and an lower arm of the layboy of FIG. 1.

The layboy 10 has an upper belt section 20 that includes a plurality of upper arms 22 (eight in this embodiment) each of which includes an upstream belt support wheel 24 at the input end 12 of the layboy 10 and a downstream belt support wheel 26 (visible in FIG. 2) at the discharge end 14 of the layboy 10 and an upper belt 28 mounted on and extending between the upstream and downstream belt support wheels 24, 26. The layboy further has a lower belt section 30 including a plurality of lower arms 32 disposed beneath the upper arms 22, an upstream belt support wheel 34 at the input end 12 of the layboy 10, a downstream belt support wheel 36 at the discharge end 14 of the layboy and a lower belt 38 mounted on and extending between the upstream and downstream belt support wheels 34, 36.

In the present embodiment, the upper belts 28 and the lower belts 38 have a substantially circular cross section, and the belt support wheels 24, 26 of the upper belt section 20 and the belt support wheels 34, 36 of the lower belt section 30 comprise flanged wheels or pulleys configured to guide these round belts. However, different belts, for example flat band-shaped belts, belts having a non-circular and/or variable cross section or V-shaped belts, could also be used on the layboy 10, and in such case the belt support wheels could be configured as, without limitation, flat rollers, sprockets or flanged wheels having a configuration adapted to the different belt shapes. All such rotatable belt supports are intended to be covered by the phase "belt support wheel" as used herein.

The downstream upper belt support wheels 26 are each mounted on a first driven shaft 40 that is operably connected to and driven by a drive 42 such as an electric motor. The upstream upper belt support wheels 24 are mounted at the ends of upper extension arms 44 and are not interconnected; they may thus rotate independently of each other, at least when not connected to the downstream upper belt support wheels 26 by an upper belt 28. The downstream lower belt support wheels 36 are mounted on a second driven shaft 46 that is operably connected to the drive 42 either directly or via the first driven shaft 40. The upstream lower belt support wheels 34 are mounted at the ends of lower extension arms 48 and are not interconnected; they are thus free to rotate independently of each other, at least when not connected to the downstream lower belt support wheels 36 by the lower belts 38.

An upstream guide arm 50 supporting a first upper guide wheel 52 and a downstream guide arm 54 supporting a second upper guide wheel 56 depend from the upper arm 22. The first and second guide wheels 52, 56 guide the bottom portion 58 of the upper belt 28 along a first plane spaced from the bottom edges of the upper support wheels 24, 26. The first upper guide wheel 52 helps to create an input nip 60 at the input end 12 of the layboy 10, and the second upper guide wheel 56 creates a discharge spacing 62 at the discharge end 14 of the layboy 10. The layboy lower arms 32 include a downstream guide arm 64 that supports a downstream guide wheel 66 to maintain a top portion 68 of the lower belt 38 in a second plane, spaced from the first plane. The bottom portions 58 of the upper belts 28 and the top portions 68 of the lower belts 38 define between them a transport path 70 for sheets of material carried through the layboy 10.

A mounting plate 72 depends from at least one of the upper arms 22 at a location between the upstream guide arm 50 and the downstream guide arm 54 and includes three diversion guides for diverting the upper belt 28 away from the first plane and away from the transport path 70 and then returning the upper belt 28 to the transport path 70. These include a first diversion guide 74 at the transport path 70, a second diversion guide 76 directly above the first diversion guide 74, and a third diversion guide 78 at the transport path 70 downstream from the first diversion guide 74. In the disclosed embodiment, the diversion guides 74, 76, 78 are flanged wheels configured to guide the round upper belts 28, but different diversion guides adapted to different types of belt could be used. The bottom 58 of the upper belt 28 thus extends from the upper upstream belt support wheel 24 past the first upper guide wheel 52 to the first diversion guide 74. The portion of the bottom 58 of the upper belt 28 from the first upper guide wheel 52 to the first diversion guide 74 may be referred to as a "first portion" or "upstream portion" of the bottom 58 of the upper belt 28. The upper belt 28 then passes around the downstream side of the first diversion guide 74 and turns approximately 90 degrees away from the first plane and follows an S-shaped path around the second diversion guide 76. The upper belt 28 leaves the second diversion guide 76 and heads toward the third diversion guide 78 at an angle and returns to the first plane and to the transport path 70 at the third diversion guide 78. The portion of the bottom 58 of the upper belt 28 between the first diversion guide 74 and the third diversion guide 78 may be referred to as the "third portion" or the "diverted portion" of the bottom portion 58 of the upper belt 28. The portion of the bottom 58 of the upper belt 28 between the third diversion guide 78 and the second upper guide wheel 56 may be referred to as the "second portion" or "downstream portion" of the bottom 58 of the upper belt 28.

Diverting the portion of the bottom 58 of the upper belt 22 between the first diversion guide 74 and the third diversion guide 78 creates a gap in the transport path, that is, a region where the upper belt 28 moves away from the transport path 70, so that blanks being transported through the layboy 10 belt are not in contact with the upper belt 28 in this diverted portion of the path. This "gap" in the transport path allows scrap material that may have entered the layboy and come to be trapped between an upper belt 28 and the top of a blank to fall or be dislodged from the blank. This reduces the likelihood that the scrap will be discharged from the layboy 10 at the discharge end 14. The removal of scrap may be aided by the presence of a fan (not illustrated) at the side of the layboy for creating an airflow inside or through the layboy 10. Significantly, the gap, or the distance between the first diversion guide 74 and the third diversion guide 78, is shorter than the length of the shortest blanks that will be conveyed through the layboy 10 so that at least part of each blank is always in contact with the upper belt 28.

Figure 3:
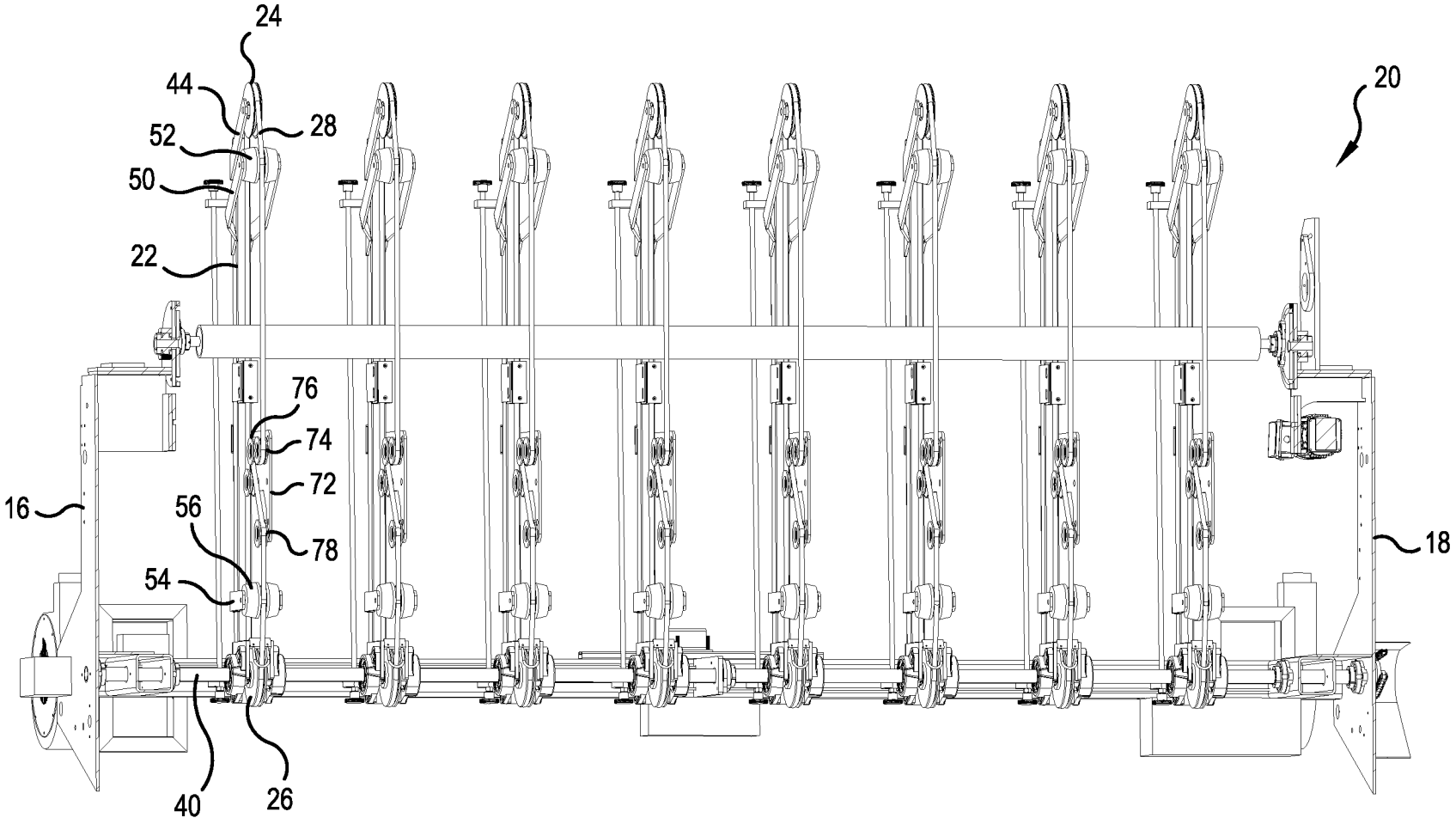
FIG. 3 is a bottom perspective view of the upper arms of the layboy of FIG. 1.
Figure 4:
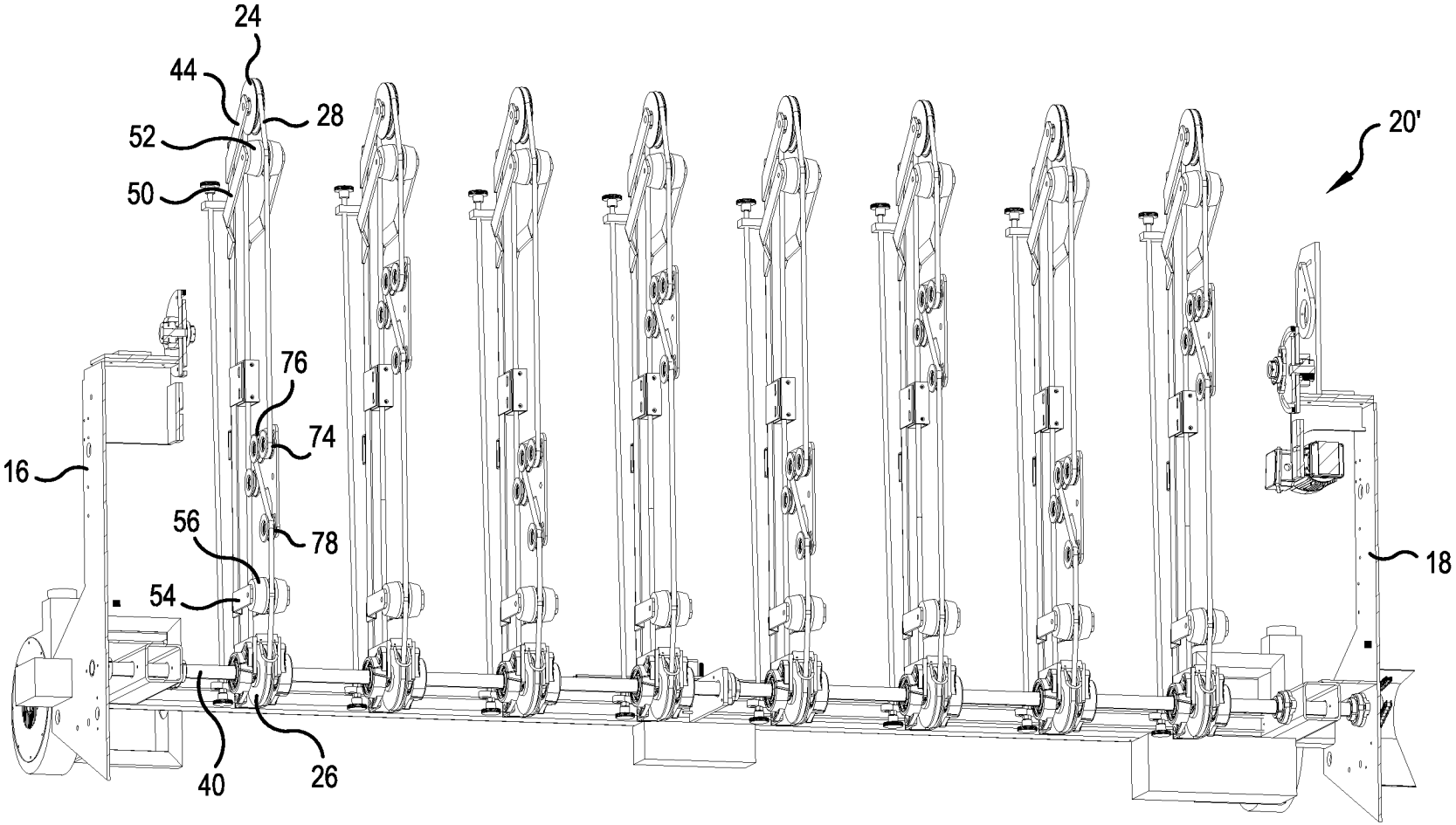
FIG. 4 is a bottom perspective view of a set of upper layboy arms according to a variation of the first embodiment of the disclosure.

The diversion guides 74, 76, 78 are preferably provided on each of the upper arms 22 to form gaps in each of the upper belts 28. The gaps can be transversely aligned, as shown in the bottom plan view of the upper arms 22 in FIG. 3, or, in the alternative, the gaps can be staggered or offset in the transverse direction as illustrated in FIG. 4 which shows an upper arm section 20'. When the gaps are aligned, long pieces of scrap that extends across multiple belts 28 may be more easily dislodged; staggering the gaps as illustrated in FIG. 4, on the other hand, may provide better control over the movement of the blanks through the layboy 10 under certain conditions.

Figure 5:
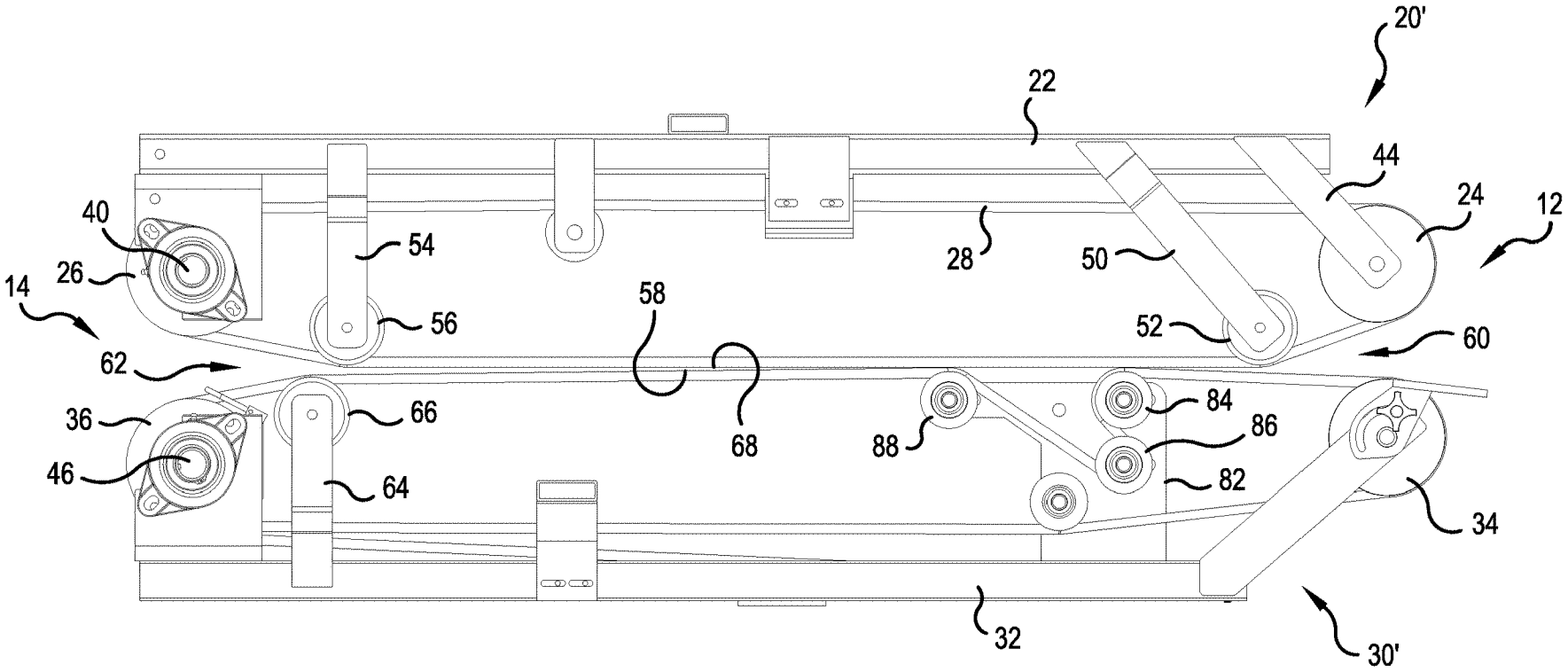
FIG. 5 is a left side elevational view of upper and lower layboy arms of a second embodiment of the present disclosure in which the upper layboy arm supports an upper belt and the lower layboy arm supports a lower belt which lower belt includes a diverted portion.

A second embodiment of the disclosure is illustrated in FIG. 5. Elements identical to those of the first embodiment are identified with like reference numerals, and only the differences between the first and second embodiments are described. As will be appreciated from FIG. 5, the upper belt section 20 of the second embodiment is substantially identical to the upper belt section 20 of the first embodiment except that the upper arms 22 do not include a mounting plate 72 with first, second and third diversion guides 74, 76, 78. Instead, the lower arms 32 of the lower arm section 30' are provided with an upwardly extending mounting plate 82, a first diversion guide 84, a second diversion 86 and a third diversion guide 88 for diverting portions of the tops 68 of the lower belts 32 away from the transport path. In this embodiment, the "gap" in the transport path 70 is formed in the lower belts 32 which gap allows any scrap trapped between a bottom side of a blank and the tops 68 of the lower belts 38 to fall away from the transport path 70.

Figure 6:
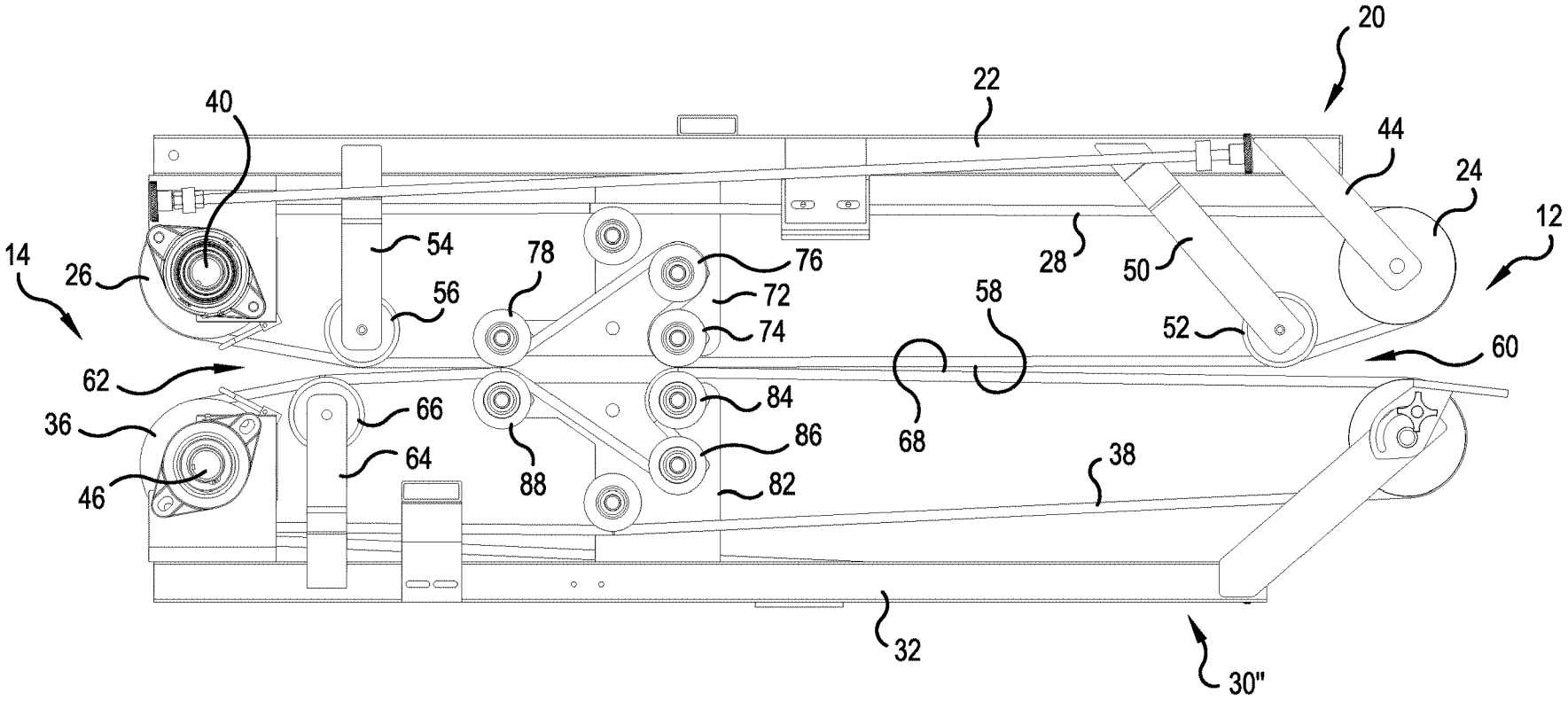
FIG. 6 is a left side elevational view of an upper layboy arm supporting an upper belt and a lower layboy arm supporting a lower belt according to a third embodiment of the disclosure in which the upper and lower belts include transversely aligned diverted portions.

A third embodiment is illustrated in FIG. 6. In this embodiment, the upper arms 22 of the upper arm section 20 includes the mounting plates 72 of the first embodiment with the first, second and third diversion guides 74, 76, 78 mounted thereon for diverting a portion of the bottoms 58 of the upper belts 28 away from the transport path, and the lower arms 32 of the lower arm section 30" include the mounting plates 82 of the second embodiment with the first, second and third diversion guides 84, 86, 88 mounted thereon for diverting a portion of the tops 68 of the lower belts 38 from the transport path 70. In this embodiment, the gaps in the upper belts 28 and in the lower belts 38 are transversely aligned.

Figure 7:
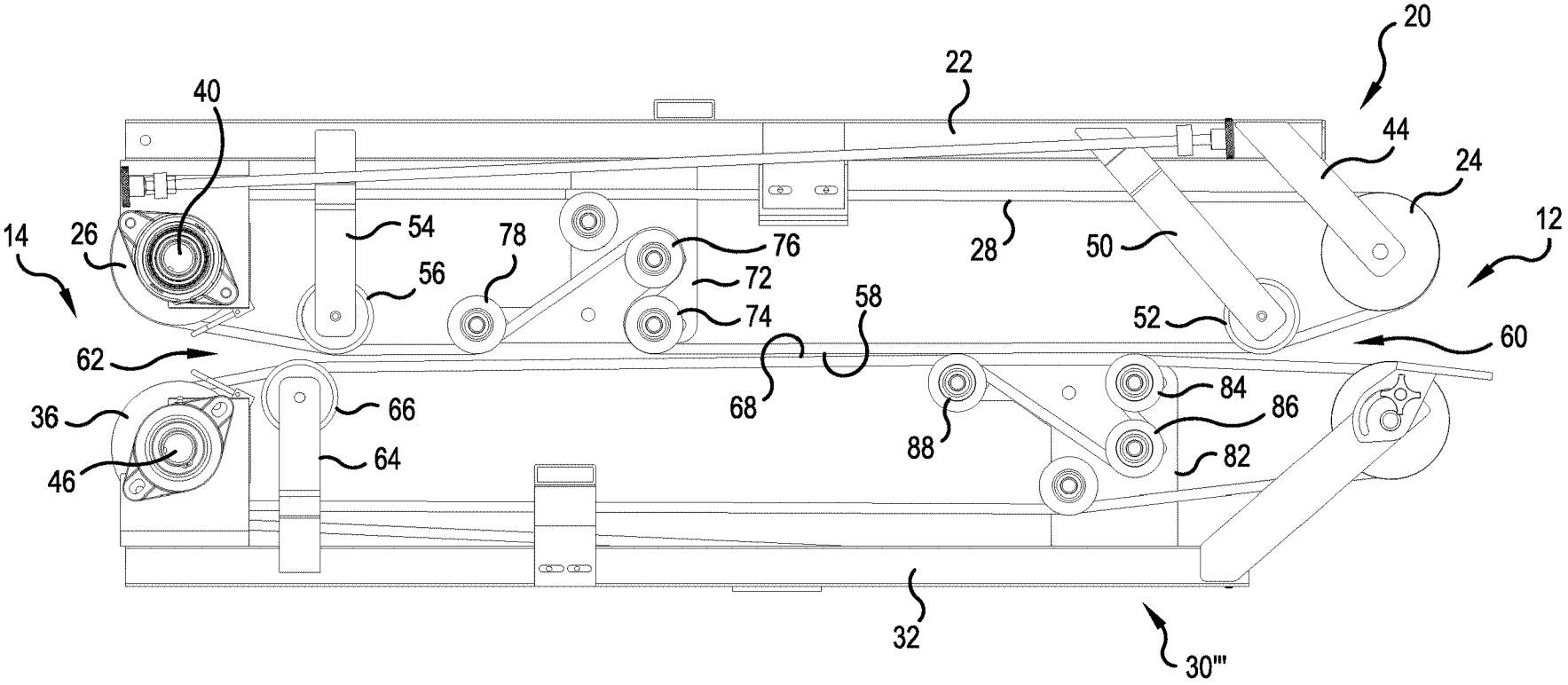
FIG. 7 is a left side elevational view of an upper layboy arm supporting an upper belt and a lower layboy arm supporting a lower belt according to a variation of the third embodiment of the disclosure in which the upper and lower belts include transversely offset diverted portions.

The fourth embodiment of the disclosure illustrated in FIG. 7 is identical to the third embodiment except that the mounting plates 72 of the upper arms 22 of the upper arm section 20 and the mounting plates 82 of the lower arms 32 of the lower arm section 30''' are longitudinally offset so that, for example, the leading edge of each of the blanks being transported is always in contact with one of the upper and lower belts 28, 38 as they pass through the layboy 10 while still allowing scrap to be removed from the upper and lower surfaces of the blanks.

The present invention has been described herein in terms of several embodiments. Modifications and additions to these embodiments will become apparent to persons of ordinary skill in the relevant arts upon a reading of the foregoing description. It is intended that all such modifications and additions comprise a part of the present invention to the extent they fall within the scope of the several claims appended hereto.

What is claimed is:

1. A layboy comprising:

an upstream end;

a downstream end spaced from the upstream end in a longitudinal direction;

an upper belt section comprising a plurality of transversely spaced upper belts extending in the longitudinal direction from the upstream end to the downstream end, each of the upper belts having a bottom defining an upper boundary of a transport path through the layboy; and a lower belt section comprising a plurality of transversely spaced lower belts extending in the longitudinal direction from the upstream end to the downstream end, each of the lower belts having a top defining a lower boundary of the transport path;

wherein:

the bottom of at least one of the plurality of upper belts includes a first portion extending from the upstream end to a first upper diversion guide, a second portion extending from the downstream end to a second upper diversion guide, a diverted portion between the first upper diversion guide and the second upper diversion guide at which the bottom of the at least one of the plurality of upper belts extends from the first upper diversion guide to a third upper diversion guide offset from the transport path and from the third upper diversion guide to the second upper diversion guide such that the diverted portion of the at least one of the plurality of upper belts is spaced from the transport path, and/or the top of at least one of the plurality of lower belts includes a first portion extending from the upstream end to a first lower diversion guide, a second portion extending from the downstream end to a second lower diversion guide, a diverted portion between the first lower diversion guide and the second lower diversion guide at which the top of the at least one of the plurality of lower belts extends from the first lower diversion guide to a third lower diversion guide offset from the transport path and from the third lower diversion guide to the second lower diversion guide such that the diverted portion of the belt is spaced from the transport path, wherein the at least one of the plurality of upper belts includes the diverted portion; and wherein none of the plurality of lower belts includes the diverted portion.

2. The layboy according to claim 1, wherein the at least one of the plurality of upper belts comprises at least two of the plurality of upper belts and wherein the diverted portions in the at least two of the plurality of upper belts are aligned when viewed in a direction transverse to the longitudinal direction.

3. The layboy according to claim 1, wherein the at least one of the plurality of upper belts comprises at least two of the plurality of upper belts and wherein the diverted portions in the at least two of the plurality of upper belts are offset when viewed in a direction transverse to the longitudinal direction.

4. The layboy according to claim 2, including a plurality of upper arms each having an upstream end and a downstream end, each of the plurality of upper arms supporting one of the plurality of upper belts, and including a plurality of lower arms each having an upstream end and a downstream end, each of the plurality of lower arms supporting one of the plurality of lower belts.

5. The layboy according to claim 4, wherein at least one of the upper arms includes a support depending from the at least one upper arm and extending past one of the upper belts, and wherein the first upper diversion guide, the second upper diversion guide and the third upper diversion guide are mounted on the support.

6. The layboy according to claim 5, including a drive and a driven shaft at the downstream end of the layboy, the driven shaft supporting a plurality of belt guides and each of the plurality of upper belts being mounted on one of the belt guides.

7. A layboy comprising:

an upstream end;

a downstream end spaced from the upstream end in a longitudinal direction;

an upper belt section comprising a plurality of transversely spaced upper belts extending in the longitudinal direction from the upstream end to the downstream end, each of the plurality of upper belts having a bottom defining an upper boundary of a transport path through the layboy; and a lower belt section comprising a plurality of transversely spaced lower belts extending in the longitudinal direction from the upstream end to the downstream end, each of the plurality of lower belts having a top defining a lower boundary of the transport path;

wherein:

the bottom of at least one of the plurality of upper belts includes a first portion extending from the upstream end to a first upper diversion guide, a second portion extending from the downstream end to a second upper diversion guide, a diverted portion between the first upper diversion guide and the second upper diversion guide at which the bottom of the at least one of the plurality of upper belts extends from the first upper diversion guide to a third upper diversion guide offset from the transport path and from the third upper diversion guide to the second upper diversion guide such that the diverted portion of the at least one of the plurality of upper belts is spaced from the transport path, and/or the top of at least one of the plurality of lower belts includes a first portion extending from the upstream end to a first lower diversion guide, a second portion extending from the downstream end to a second lower diversion guide, a diverted portion between the first lower diversion guide and the second lower diversion guide at which the top of the at least one of the plurality of lower belts extends from the first lower diversion guide to a third lower diversion guide offset from the transport path and from the third lower diversion guide to the second lower diversion guide such that the diverted portion of the at least one of the plurality of lower belts is spaced from the transport path, the at least one of the plurality of upper belts comprises at least two of the upper belts and wherein the at least two of the upper belts include the diverted portions, and the at least one of the plurality of lower belts comprises at least two of the lower belts, and wherein the at least two of the lower belts include the diverted portions.

8. The layboy according to claim 7, wherein the diverted portion in the at least two of the upper belts is located directly above the diverted portion in the at least two of the lower belts.

9. The layboy according to claim 7, wherein the diverted portion in the at least two of the upper belts is not located directly above the diverted portion in the at least two of the lower belts.

10. A layboy comprising:

an upstream end;

a downstream end spaced from the upstream end in a longitudinal direction;

an upper belt section comprising plurality of upper arms including a first upper arm and a second upper arm, each of the plurality of upper arms including an upstream belt support at the upstream end and a downstream belt support at the downstream end and an upper belt supported by and extending around the upstream belt support and the downstream belt support, the upper belt having a bottom portion defining an upper boundary of a transport path through the layboy, a lower belt section comprising plurality of lower arms, each of the plurality of lower arms including an upstream belt support at the upstream end of the lower arm and a downstream belt support at the downstream end of the lower arm and a lower belt supported by and extending around the upstream belt support on the lower arm and the downstream belt support on the lower arm, each of the plurality of lower belts having a top portion defining a lower boundary of the transport path, a support member depending from the first upper arm, the support member including a first diversion guide, a second diversion guide and a third diversion guide, wherein the upper belt on the first upper arm extends from the upstream belt support of the first upper arm to the first diversion guide, the third diversion guide, the second diversion guide and the downstream belt support, in order, wherein the third diversion guide is offset from the transport path such that a gap in the transport path is formed between the first diversion guide and the second diversion guide.

11. The layboy according to claim 10,
wherein the third diversion guide is located directly above the first diversion guide.

12. The layboy according to claim 10,
including a drive,
wherein the plurality of downstream belt supports of the plurality of upper arms and/or the plurality of downstream belt supports of the plurality of lower arms are operably connected to the drive.

* * * * *